US009682277B2

(12) United States Patent
Gordon

(10) Patent No.: US 9,682,277 B2
(45) Date of Patent: Jun. 20, 2017

(54) EXERCISE DEVICE

(71) Applicant: Joel Gordon, Owings Mills, MD (US)

(72) Inventor: Joel Gordon, Owings Mills, MD (US)

(73) Assignee: FIT-NOVATION, INC., Owings Mills, MD (US)

( * ) Notice: Subject to any disclaimer, the term of this patent is extended or adjusted under 35 U.S.C. 154(b) by 27 days.

(21) Appl. No.: 14/951,521

(22) Filed: Nov. 25, 2015

(65) Prior Publication Data

US 2016/0166875 A1 Jun. 16, 2016

Related U.S. Application Data

(60) Provisional application No. 62/124,178, filed on Dec. 10, 2014.

(51) Int. Cl.

| | |
|---|---|
| ***A63B 21/00*** | (2006.01) |
| ***A63B 22/00*** | (2006.01) |
| ***A63B 22/06*** | (2006.01) |
| *A63B 21/012* | (2006.01) |
| *A63B 21/02* | (2006.01) |
| *A63B 21/055* | (2006.01) |

(52) U.S. Cl.

CPC ..... *A63B 22/001* (2013.01); *A63B 22/0015* (2013.01); *A63B 22/0056* (2013.01); *A63B 22/0064* (2013.01); *A63B 22/0664* (2013.01); *A63B 21/012* (2013.01); *A63B 21/023* (2013.01); *A63B 21/055* (2013.01); *A63B 21/154* (2013.01); *A63B 22/0017* (2015.10); *A63B 2022/0051* (2013.01); *A63B 2022/0682* (2013.01)

(58) Field of Classification Search

USPC ..... 482/52

See application file for complete search history.

(56) References Cited

U.S. PATENT DOCUMENTS

| | | | |
|---|---|---|---|
| 6,036,622 | A | 3/2000 | Gordon |
| 7,645,215 | B2 | 1/2010 | Gordon |
| 7,833,134 | B2 | 11/2010 | Gordon |
| 8,109,861 | B2 | 2/2012 | Gordon et al. |
| 8,409,058 | B2 | 4/2013 | Gordon et al. |
| 9,050,491 | B2 | 6/2015 | Gordon et al. |

FOREIGN PATENT DOCUMENTS

| | | |
|---|---|---|
| CH | 8631 | 12/1894 |
| CH | 320410 | 3/1957 |

*Primary Examiner* — Jerome W Donnelly

(74) *Attorney, Agent, or Firm* — Galbreath Law Offices, P.C.; John A. Galbreath

(57) ABSTRACT

An exercise device with a pair of upper links coupled to the frame and a pair of lower links pivotally coupled to the upper links is provided. A pair of pedals is received on a distal end of each of the lower links. A transfer system between the pair of upper links may include a first and a second pushrod, each with a first end pivotally coupled to each upper link and a second end opposite to the first end. A first and a second pivot arm, each pivotally coupled to the frame, may be included, each pivot arm receiving a respective pushrod. A pliable connector may be coupled to the first pivot arm and the second pivot arm, thus providing compliant reciprocating movement of the upper links.

8 Claims, 14 Drawing Sheets

EXERCISE DEVICE

CROSS-REFERENCES TO RELATED APPLICATIONS

This application claims priority from, and the benefit of, applicant's provisional U.S. Patent Application No. 62/124,178, filed Dec. 10, 2014 and titled "Exercise Device". The disclosures of said provisional application and its entire file wrapper (including all prior art references cited therein) are hereby specifically incorporated herein by reference in their entirety as if set forth fully herein.

BACKGROUND OF THE INVENTION

1) Field of the Invention

The present invention generally relates to exercise devices and, more particularly, to an exercise device that may allow the user to simulate running, walking or other gait patterns.

2) Description of the Related Art

There have been exercise devices, such as a treadmill, which allow a user to walk or run in a limited space. One of the limitations of running on a treadmill is the impact of the foot with the deck of the treadmill, which may result in overuse injuries to the joints of the lower body. As a response to the market need of low impact cardiovascular exercise, devices such as elliptical exercisers were developed. One of the limitations to these devices is the pedals move in one restricted pattern. Not only do individuals like to change their gait pattern from walking to running to sprinting and so on, but different people have different natural gait patterns while doing the same type of movement, be that running, walking or any other movement. This may be due to differences in limb length and other physical developmental differences between people. Therefore it would be desirable to provide a low impact exercise device in which the machine would follow the movement of the user and not make the user follow the movement of the machine.

SUMMARY OF THE INVENTION

The present invention may provide a pair of upper links coupled to the frame and a pair of lower links pivotally coupled to the upper links. A pair of pedals may be received on a distal end of each of the lower links. A transfer system between the pair of upper links may include a first and a second pushrod, each with a first end pivotally coupled to each of the upper links and a second end opposite to the first end. A first and a second pivot arm, each pivotally coupled to the frame, may be included, each pivot arm receiving a respective pushrod. A pliable connector may be coupled to the first pivot arm and the second pivot arm, thus providing compliant reciprocating movement of the upper links. The device may further include a connector damper in parallel with the pliable connector, thus damping the movement of the first pivot arm relative to the second pivot arm.

The device may also include a drive ear pivotally coupled to the frame at a frame pivot. The drive ear may be coupled to a leg damper on a first side of the frame pivot and a lower leg connector on a second side of the frame pivot. A spring may be positioned so as to bias the drive ear in the direction of compression of the leg damper.

A pair of frame wheels coupled to the frame to enable side to side movement of the frame when supported on the frame wheels. The frame may also include a front leg with a wheel mounted thereto, which may be movably coupled to the rest of the frame, whereby movement of the front leg enables the leg wheel to run parallel to the frame wheels.

A handle may be pivotally coupled to the first upper link and an arm bar with a first pivot on the handle and a second pivot on the frame. A rebound spring may be mounted on the frame and proximate to the drive ear, such that the rebound spring may provide an interference to continued movement of the drive ear.

For purposes of summarizing the invention and the advantages achieved over the prior art, certain advantages of the invention have been described herein above. Of course, it is to be understood that not necessarily all such advantages can be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment(s) disclosed.

BRIEF DESCRIPTION OF THE DRAWINGS

Embodiments of the present invention will now be described, by way of example only, with reference to the following drawings, in which.

DETAILED DESCRIPTION OF THE INVENTION

Figure 1:
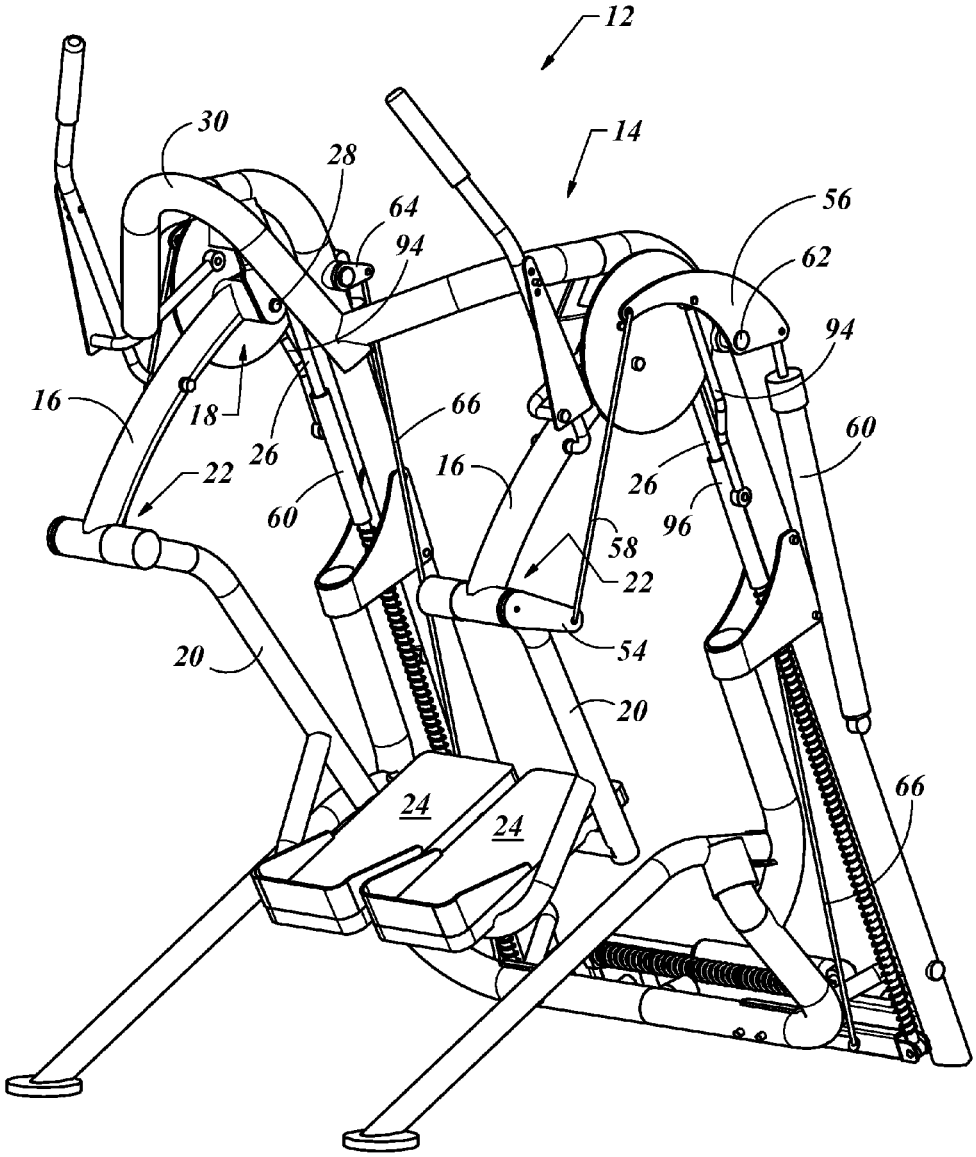
FIG. 1 is an isometric view of an exercise device produced in accordance with the present invention.
Figure 2:
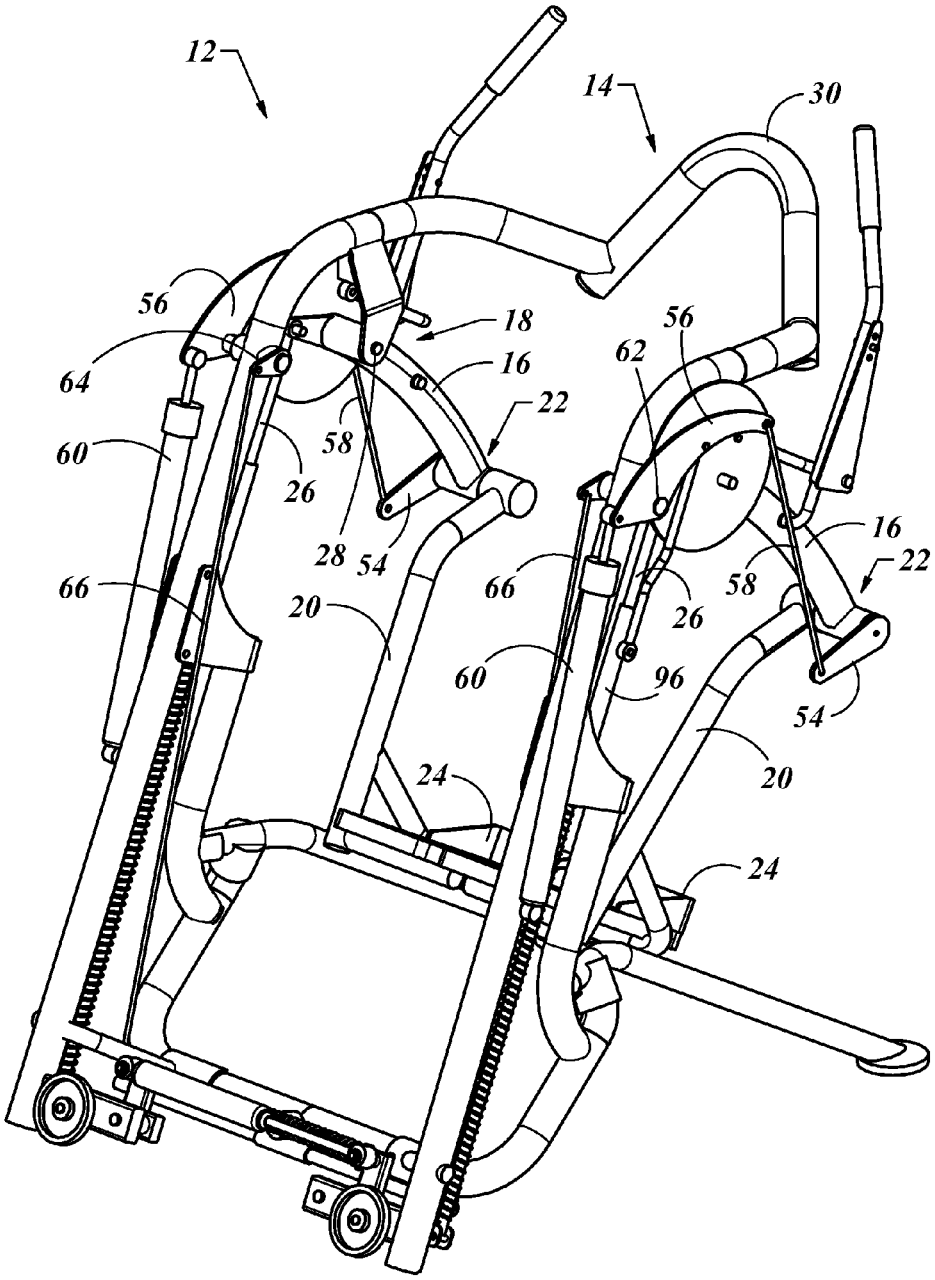
FIG. 2 is an isometric view of the exercise device of FIG. 1, shown from the rear of the device.

With reference to the illustrative drawings, and particularly to FIGS. 1 and 2, there is shown an exercise device 12 including a frame 14 which supports a pair of upper links 16. The upper links 16 may include a first end 18 which may be pivotally coupled to the frame 14 at the first end 18 of each upper link 16. A pair of lower links 20 may be pivotally coupled to a second end 22 of the upper links 16, and may also include a pair of pedals 24 on a distal end of each of the lower links 20. The pedals 24 may be suited to support the weight of the user.

A control system may be provided to offer mechanical communication between the upper links 16. This control system may include a pair of pushrods 26, which may be pivotally coupled to the upper links 16. The primary pivot 28 of the upper links 16 to the frame 14 may be positioned such that the body of the upper links 16 may be substantially opposite to the connection to the pushrods 26 relative to the primary pivot 28. In this way, as the body of the upper links 16 move downward, the pushrod 26 may move upward. This arrangement of the connection of the pushrod 26 being on the opposite side of the primary pivot 28 relative to the body of the upper links 16, is not mandatory but will be used as an example of one embodiment of the invention throughout this disclosure.

A typical use of the device 12 may include a user with their feet positioned on the pedals 24, standing substantially upright and facing forward toward the front hoop 30 of the frame 14. The hip region of the user may be positioned adjacent to the primary pivot 28. As the user would perform a walking or running motion, each foot pedal 24 may move in a direction that may be different from the other foot pedal 24. In this process the upper links 16 may move in a somewhat reciprocating pattern. Just as in walking, as the right upper leg moves forward, the left upper leg would move backward. A similar movement may be seen in the use of this device 12.

Figure 3:
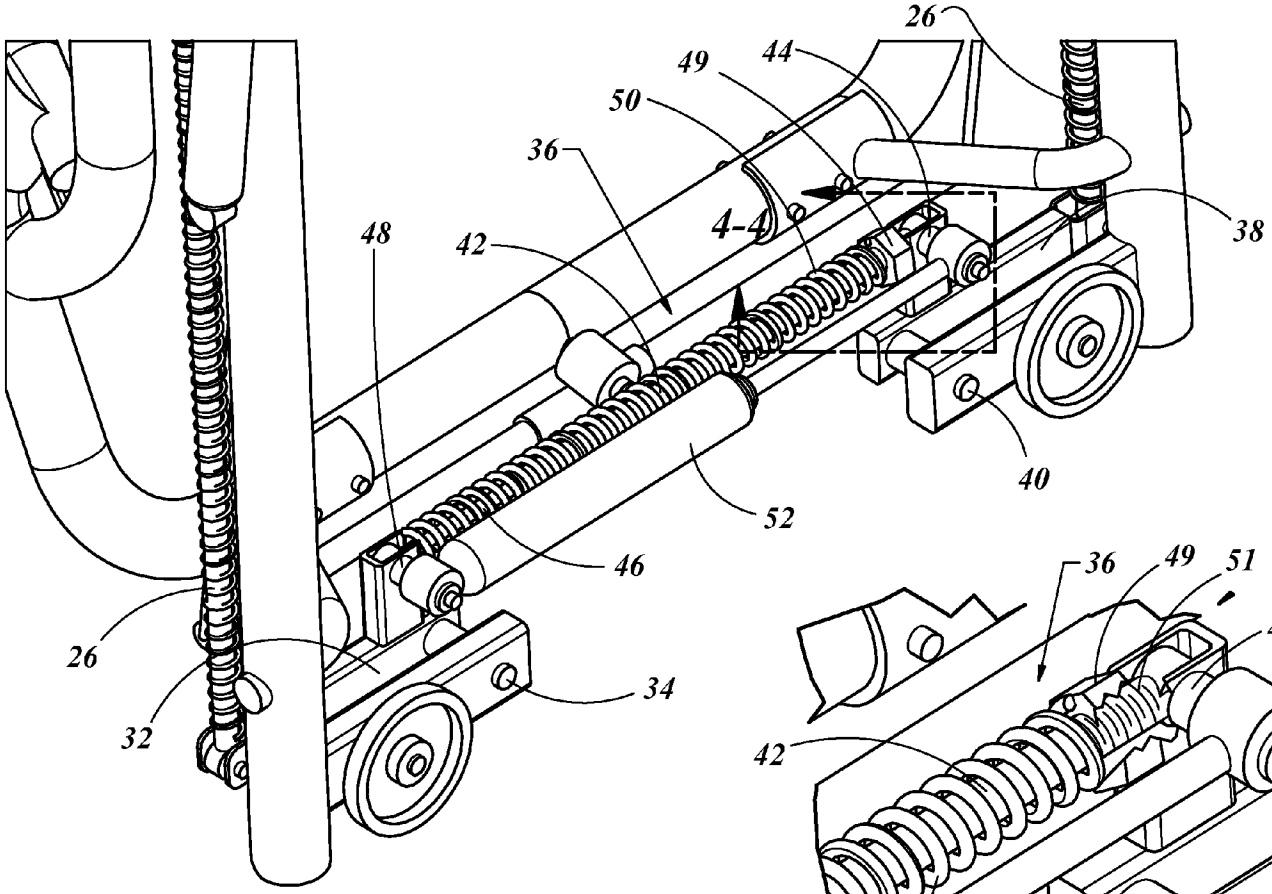
FIG. 3 is an isometric partial view of the device of FIG. 1, featuring a lower portion of the device.
Figure 4:
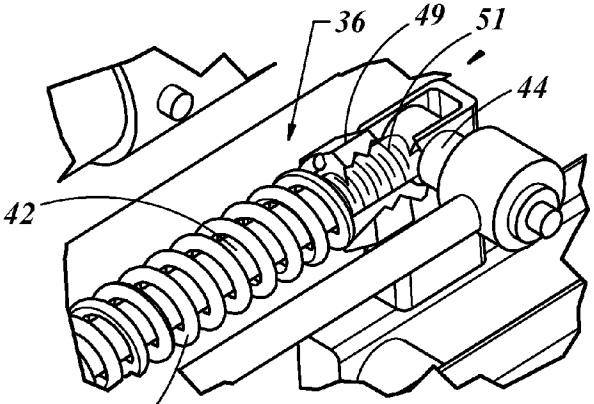
FIG. 4 is a detailed view of a rear, bottom portion of the device shown in FIG. 3, shown cut along line 4-4.
Figure 5:
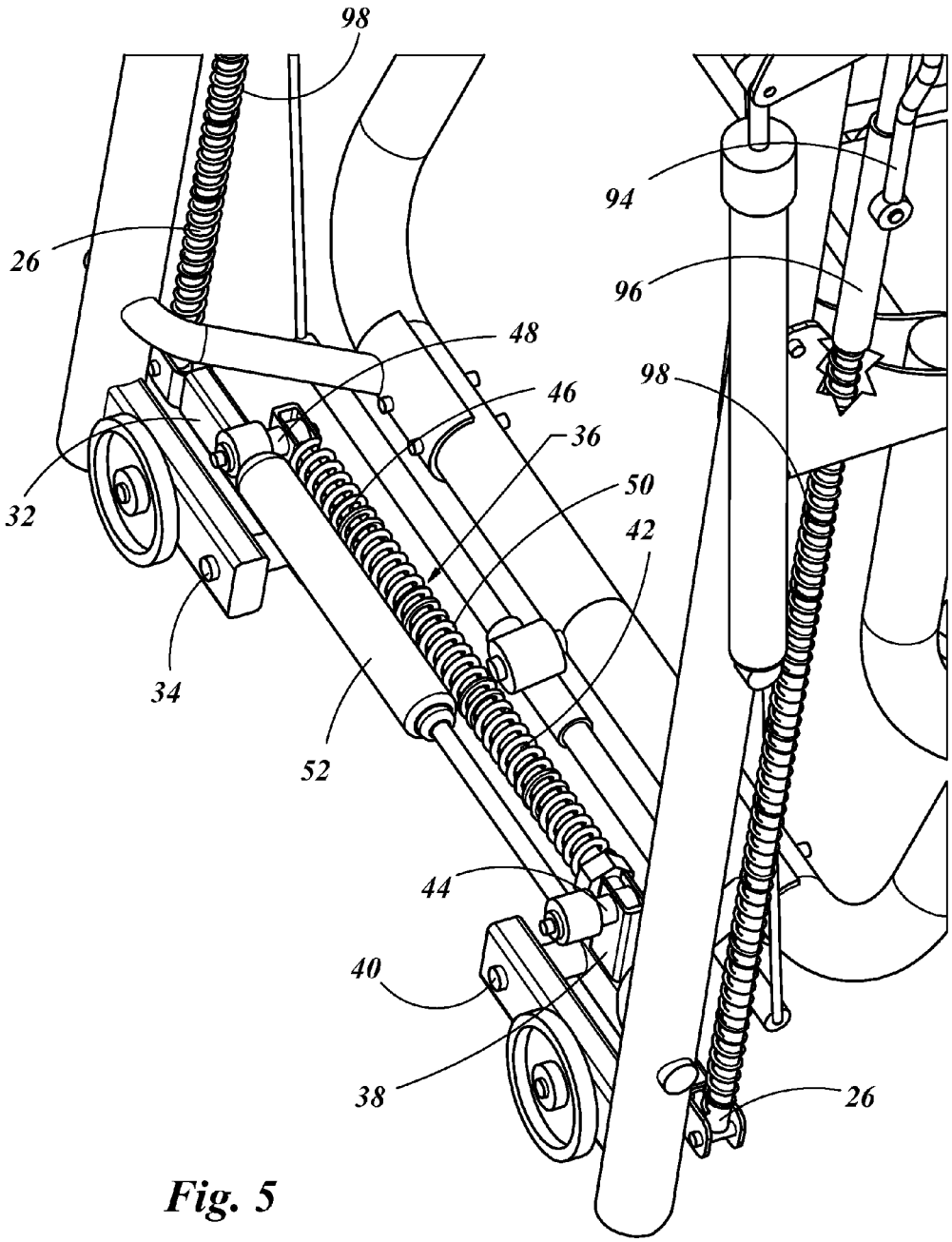
FIG. 5 is an isometric partial view of the device of FIG. 1 further showing the lower rear portion of the device.
Figure 6:
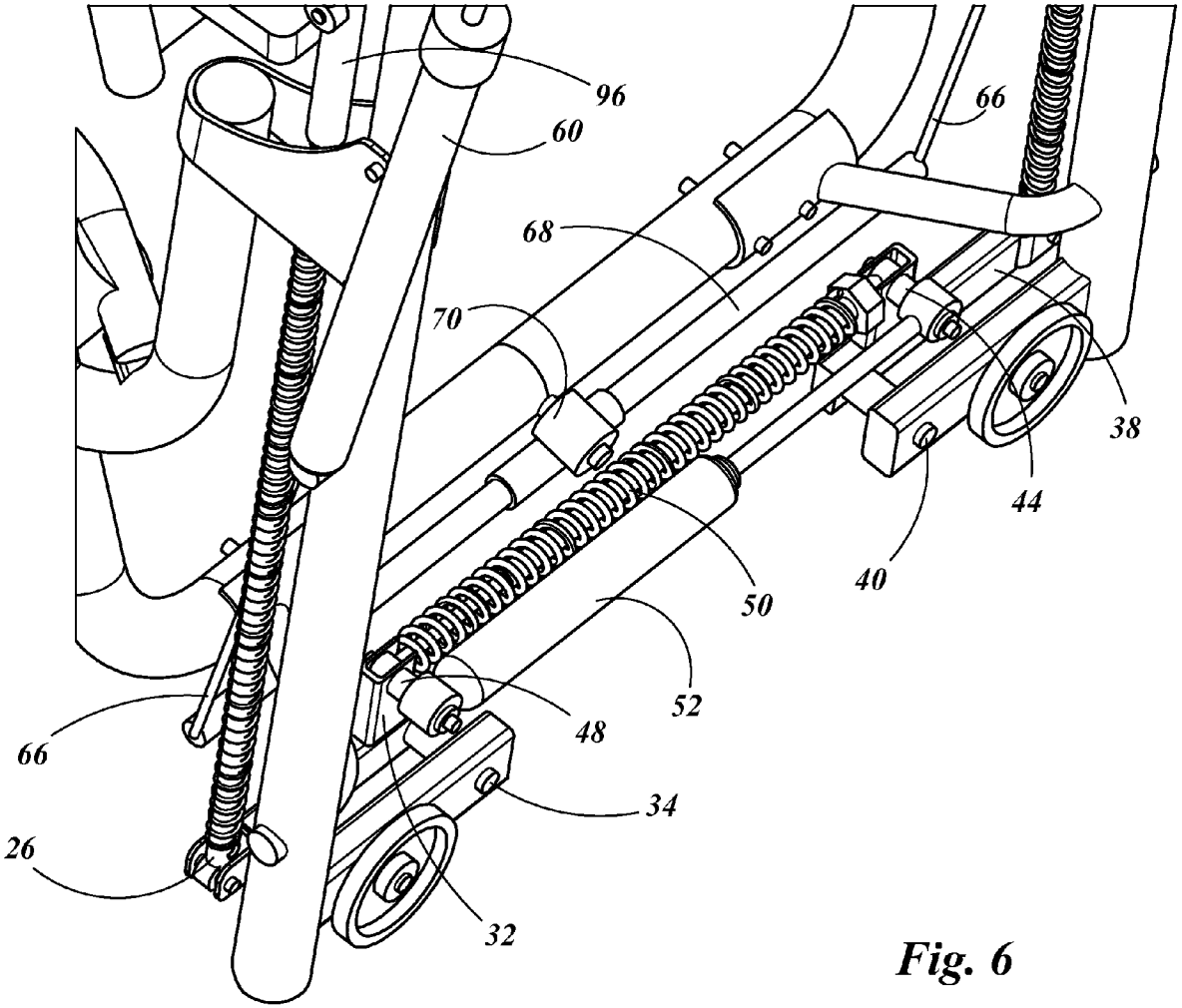
FIG. 6 is an isometric partial view of the device of FIG. 5 showing more detail of a lower portion of the device.
Figure 7:
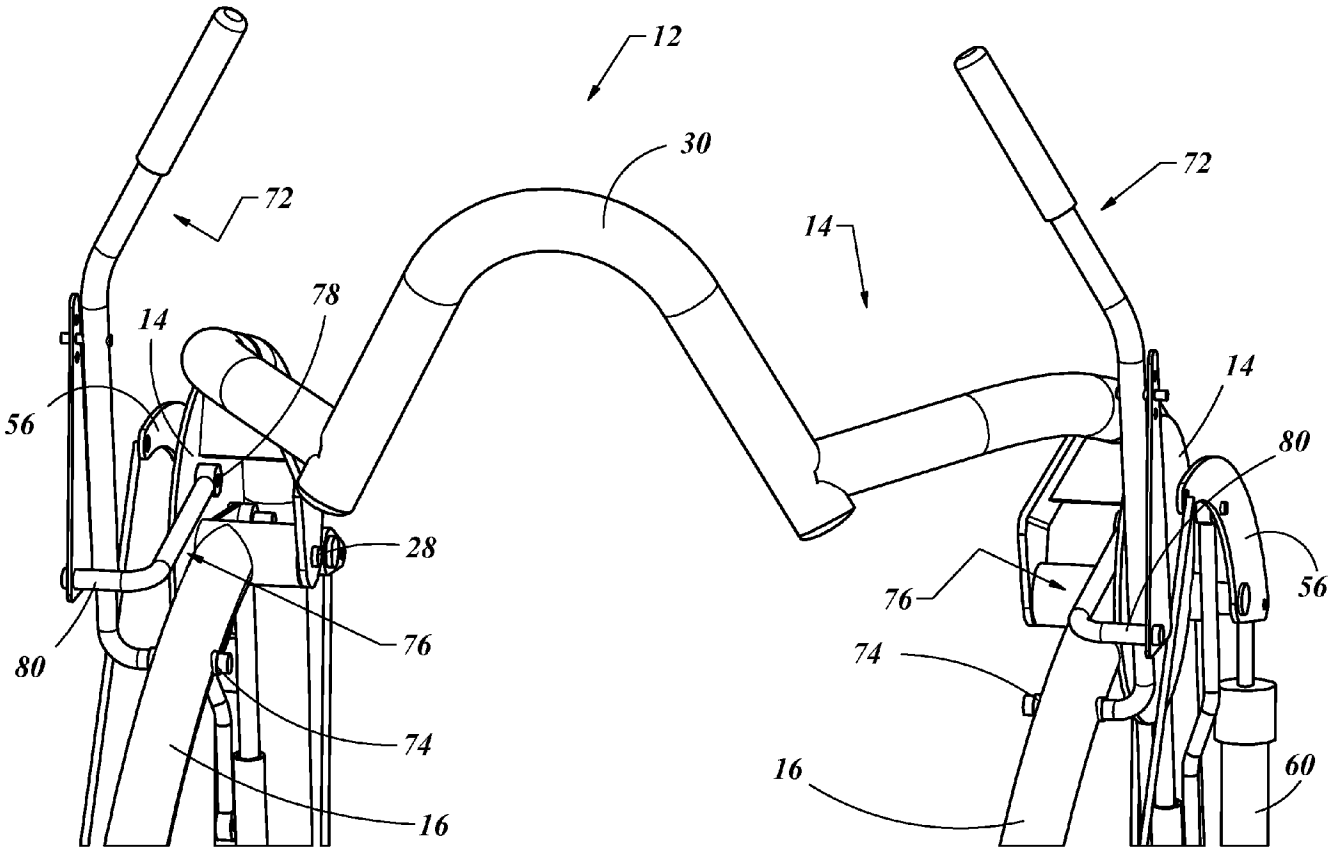
FIG. 7 is an isometric partial view of the device of FIG. 1 showing a pair of limited range arm handles.

It may not be desirable for the left upper link 16 to operate in a purely reciprocating manner relative to the right upper link 16. In other words, for every degree of rotation backward of one upper link 16 it may be desirable for the other upper link 16 to move forward at a slightly different degree of rotation. With reference to FIGS. 3, 4 and 5, one example of a mechanical connection which may allow for compliance of movement of one upper link 16 relative to the other upper link 16 is shown. As previously stated, the two pushrods 26 may move in conjunction with, but as in this case, substantially opposite to, their respective upper links 16. If the upper link 16 on the left of the device 12 were to move downward and backward, the respective pushrod 26 on the left of the device 12 would be driven upward. In this instance, the left damper arm 32 may rotate upward about the left damper pin 34. This movement would put a compression force on the pliable connector 36, thus providing a moment to rotate the right damper arm 38 downward or clockwise about the right damper pin 40. This rotation movement of the right damper arm 38 may cause the pushrod 26 on the right side of the device 12 to move downward, thus rotating the upper link 16 on the right side of the device 12 to move forward.

An advantage to having a compliant connector 36 to connect the left damper arm 32 to the right damper arm 38 is that movement of the right damper arm 32 does not necessitate equal but opposite movement of the right damper arm 38. In doing so, the user may have the capability of overcoming the compliant capability of the pliable connector 36, and as such enable the device 12 to better conform to the desired movement of the user. The detail of the components of the compliant connector 36 may vary according to engineering or design needs. In this embodiment one version is shown, which may include a sleeve 42 pivotally connected to the right damper arm 38 at the right shaft 44. This sleeve 42 may receive a bar 46, which may be pivotally connected to the left damper arm 32 at the left shaft 48. The bar 46 may slide freely within the sleeve 42 thus allowing a variation in distance between the right shaft 44 and the left shaft 48.

In order to provide a baseline distance between the right shaft 44 and the left shaft 48 one or more springs 50 may be used. As it may be desirable for the device 12, when not in use, to have a substantially symmetrical orientation, there may be an optimal distance between the right shaft 44 and the left shaft 48. This optimal distance may be considered a baseline such that when the pedals 24 are not loaded by the weight of a user this optimal distance is resumed. The spring 50 at a relaxed length may be positioned to provide this optimal distance between the right shaft 44 and the left shaft 48. When the left damper arm 32 or the right damper arm 38 is rotated upward, a compressive load may be placed on the spring 50. The spring 50 may then apply a force to the other damper arm (32 or 38) to move it in a substantially equal but opposite direction.

In this arrangement of the device 12, the driving force may likely come from the movement of the upper link 16 which is moving downward, as is the case when a user would be stepping down, moving their foot down relative to the rest of their body. That movement would in this case cause that relative pushrod 26 to move upward. This may rotate that damper arm (32 or 38) upward and put a compression force on the spring 50 as previously described. The recoil movement of the upper link 16 is analogous to the swing phase, or forward movement of the upper leg during a walking or running gait. This process usually has very little resistance to movement as the forward moving upper link 16 is seldom pulled forward by the user but rather pushed forward by the opposite movement of the other upper link 16. As such, it may not be necessary to provide a second spring to transfer a tensile force between the left damper arm 32 and the right damper arm 38 in order to maintain an optimal distance between the right shaft 44 and the left shaft 48 as previously discussed. If the user applied a force to hold their foot forward, and therefore that respective upper link 16 forward, a second spring may be provided to connect the bar 46 to the sleeve 42. In doing so, the tensile force applied by the spring (not shown) would be balanced by the compression forces of the spring 50 so that in the absence of any outside forces applied to the device 12, and the system is in equilibrium, the optimal distance between the right shaft 44 and the left shaft 48 may be maintained.

It may also be desirable to include a damper 52 that may be provided in parallel to the pliable connector 36. The function of the damper 52 may be to provide a smooth movement from, and recoil to, the optimal distance dimension. In addition, when only one spring 50 is provided to transfer a compression force, as shown, and in the absence of any spring that would provide a tensile force between the right damper arm 32 and a left damper arm 38, the damper 52 may be set to provide a maximum extension distance equal to the optimal distance between the right shaft 44 and the left shaft 48. As noted, in the event that only a compression force is seen by the pliable connector 36, the damper 52 may also act as a range limiter to prevent movement that would result in a distance greater than the optimal distance between the right shaft 44 and the left shaft 48.

One method of adjustment of the pliable connector 36 is shown in FIG. 4. This embodiment shows a spring nut 49 in FIG. 3, which may contact the spring 50. The detail in FIG.

4 shows the spring nut 49 being partially cut away to reveal a threaded portion 51 on one end of the sleeve 42. This end of the sleeve 42 may be received by the right shaft 44 with the spring nut 49 positioned between the spring 50 and the right shaft 44. If the spring nut 49 is advanced toward the spring 50, the spring 50 may be shortened and therefore compressed so as to provide a force on the left damper arm 32 near the left shaft 48. The more the spring nut 49 is moved toward the spring 50, the greater the resting force, or preload, the spring 50 will apply to the left damper arm 32. Advancing the spring nut 49 toward the spring 50 may be an alternative to altering the spring constant, or force applied by the spring 50 given a set deformation from its starting position. The greater the resistance offered by the spring 50, the quicker and more responsive the compliant connector 36 may react to return to the optimal distance between the right shaft 44 and the left shaft 48 during use. If the spring nut 49 is moved away from the spring 50, thereby simulating a reduced spring constant of the spring 50, the pliable connector 36 may allow for more compliance between the left and right pedals 24 during use and therefore have a "softer" feel. The adjustment of the spring nut 49 may be driven by a powered source such as a motor. The spring nut 49 may also take the form of any other movably adjustable spacer capable of applying a compressive force to the spring 50, and is not limited to the form of a threaded fastener as shown here.

With reference to FIGS. 1, 2, 6 and 7, a foot lift enhancement system and a braking system are shown. In the embodiment as shown in FIG. 1, the lower links 20 may include a lower link ear 54. The lower link ears 54 may be rigidly coupled to the respective lower links 20. Therefore, rotational movement of the lower links 20 about the end of second end 22 of the upper links 16 may result in the same respective rotary movement of the lower link ear 54. The lower link ears 54 may be connected to a drive ear 56 by way of a lower leg connector 58. The drive ear 56 may be pivotally coupled to the frame 14 such that movement of the lower leg connector 58 may provide angular displacement of the drive ear 56 relative to the frame 14. Movement of the lower leg connector 58 may be a product of movement of the upper link 16 on that side of the device 12, in that the axis of the drive ear 56 (pivotal mount 62) may not be collinear with the primary pivot 28, which is the pivot of the upper links 16 on the frame 12. It may be desirable to provide a more substantial angular displacement of the drive ear 56 from the rotation of the respective lower link 20 relative to the upper link 16.

In some cases it may be desirable to dampen or restrict the movement of the lower links 20 relative to the frame 12, providing a type of braking system. This may be accomplished by providing a leg damper 60 between the frame 12 and the drive ear 56. This combination may take many forms, but the inventor has found that it may be desirable to have a leg damper 60, which may be coupled to the drive ear 56, opposite to the lower leg connector 58 relative to the pivotal mount 62 of the drive ear 56 to the frame 12. This may make the drive ear 56 a class one lever in that downward movement of one end of the drive ear 56 results in upward movement of the opposite end of the drive ear 56. With this configuration, it may be desired to have the leg damper 60 provide a resistance to extension and a free return to a compressed state. A spring may be added to the leg damper 60 to facilitate the compression or recoil of the leg damper 60 biased toward a retracted state. In this manner, the leg damper 60 may provide a resistance to rotation of the lower links 20 relative to their respective upper link 16, as would be the case in the support phases of walking or running, but allow for minimal resistance, and possibly add some assistance to the forward moving swing phase of the lower link 20 during walking or running. The action of the leg damper 60 may provide a resistance to movement of the lower links 20 during the extension of the user's legs. This may increase the stability of a user as they are supported on the pedals 24 of the device 12.

It may also be desirable to facilitate or enhance the rebound of the vertical lift of the pedals 24 during the swing phase of the movement. To do this, one method is to provide a secondary ear 64, which may move in a manner that is consistent with the drive ear 56 pivotally coupled to the frame 12. The secondary ears 64 may be coupled to a front pull-rod 66. The front pull-rod 66 may also be a cable or other flexible tensile member. Pivotally coupled to the frame 12, there may be provided a pivot bar 68, as shown in FIG. 5. The pivot bar 68 may be pivotally coupled to the frame 12 at or near the center of the pivot bar 68 at the hinge pin 70. The combination may also act as a class one lever when one front pull-rod 66 is pulled upward; the opposite front pull-rod 66 is driven downward. The combination may provide for a substantially reciprocating movement of the lower links 20 relative to one another. In this way, the driving leg (the one supporting the user's body weight and usually moving down and rearward) may pull up on that front pull-rod 66. This may cause the opposite front pull-rod 66 to move downward, actuating the secondary ear 64 and therefore the drive ear 56 on that side of the device 14. This downward rotation of the back of that drive ear 56 may provide tension in the lower leg connector 58 on that side of the device 12. This may cause the corresponding lower link 20 to pull upward, assisting to lift that corresponding foot of the user.

The inventor has also found that it may be desirable to eliminate both front pull-rods 66, thereby also eliminating the need for the pivot bar 68. The removal of these items from the device 12 may remove the interconnectivity between the lower links 20. The system as disclosed may provide a level of dependency between each of the lower links 20 in that as one lower link 20 moves the combination of the front pull-rods 66 move relative to the interaction provided by the pivot bar 68. This dependency may add to the stability experienced by a user supported on the pedals 24, and therefore may be desired. Some users may desire a more dynamic and less controlled version of the device 12. The inventor has found that the removal of the pivot bar 68 and the front pull-rods 66 may provide this increased level of freedom of movement by allowing for independently moving lower leg links 20, moving independently relative to each another.

It is also possible to maintain the interconnectivity of the lower links 20, as with the system as shown and described using the two front pull-rods 66 and the pivot bar 68 and then disconnect the pushrods 26, thus unlinking the upper links 16 from any form of reciprocating or semi-reciprocating motion. This may be done for the same reasons as previously noted in that some users may desire a more "free" and less controlled movement.

It should also be noted, that the pliable connector 36 as shown as may be used to connect the right and left upper links 16, may also be used to connect the lower links 20. Likewise, this pliable connector 36 may be duplicated, in which there may be one pliable connector 36 for the upper links 16 and a second pliable connector 36 to provide communication between the lower links 20. In this case, both of the two pliable connector 36 systems could be present on the device 12 and each operate independently of the other pliable connector 36.

The pivot bar 68 may be a rigid structure so that for every angle of displacement in one direction on one side of the hinge pin 70 the opposite side of the hinge pin 70 is rotated an equal but opposite amount of angular displacement. An alternative is that the pivot bar 68 be made of a compliant material such as a plastic, fiberglass, spring steel, aluminum or a similar material that can flex and spring back to its original shape. In this way the connection between the right and left front pull-rods 66, and therefore the articulation of the lower links 20, may not be in perfect reciprocal motion. This may be desirable in order to allow for compliance between the right and left pedals 24 to potentially make a more accommodating movement in different gait patterns or varying gaits between individuals. In addition, the slight spring effect of the release of the energy storage due to the deformation of the pivot bar 68 may offer an added lift to the recoiling pedal 24 at certain segments of motion of the pedal 24. This may have a desirable feel to a user, thus encouraging the user to continue exercising.

Some older linkage based cardiovascular training products may include handles which are fixed to a link. As the link moves at a specified angle of rotation, the corresponding handle does the same. A different system is shown here in FIG. 6. Here a pair of handles 72 may each be pivotally mounted to the respective upper links 16 at the bearings 74 on the right and left side of the device 12. To control the amount of rotation of the handle 72 with respect to the movement of the upper links 16, a linkage system may be used. In this embodiment a handle drive bar 76 may be pivotally coupled to the frame 14 at a pin 78. The pin 78 may be stationary with respect to the frame 14. A bar end 80 of the handle drive bar 76 opposite to the connection at the pin 78 may be coupled to the handle 72 at a location not collinear with the bearings 74. The result is the handle 72 may move in response to the movement of the upper links 16, but the degree of movement of the handle 72 relative to the frame 14 may be different from that of the upper links 16 relative to the frame 14. In so doing, the movement of the handles 72 relative to the user, may be determined independently of the movement of the upper links 16, yet still driven by the movement of the upper links 16. This may provide a smooth and stable platform for the user and allow a more natural movement of the hands during different gait patterns of the user on the device 12.

Figure 8:
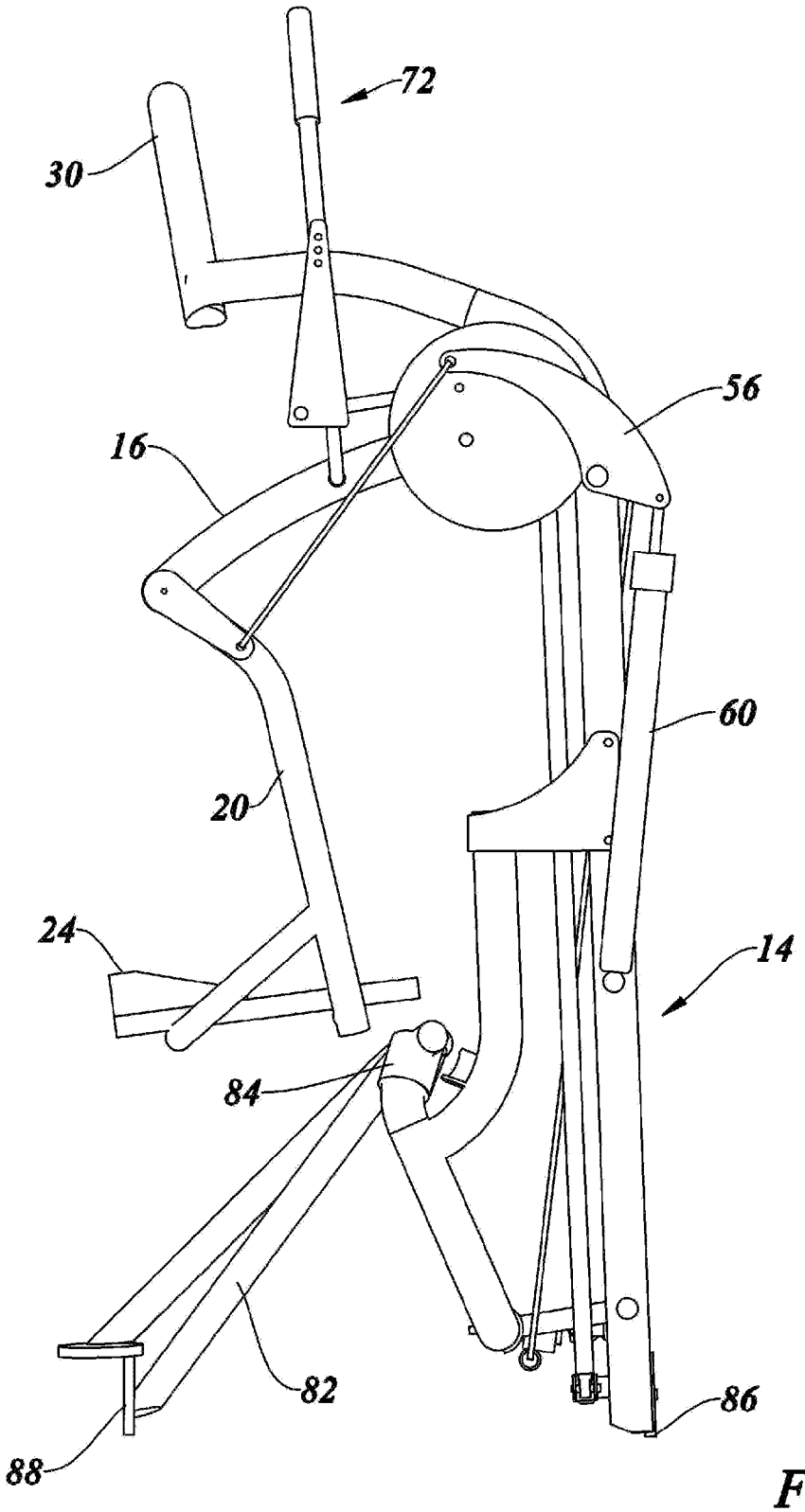
FIG. 8 is a side view of the device of FIG. 1 with the frame adjusted for storage or transport.
Figure 9:
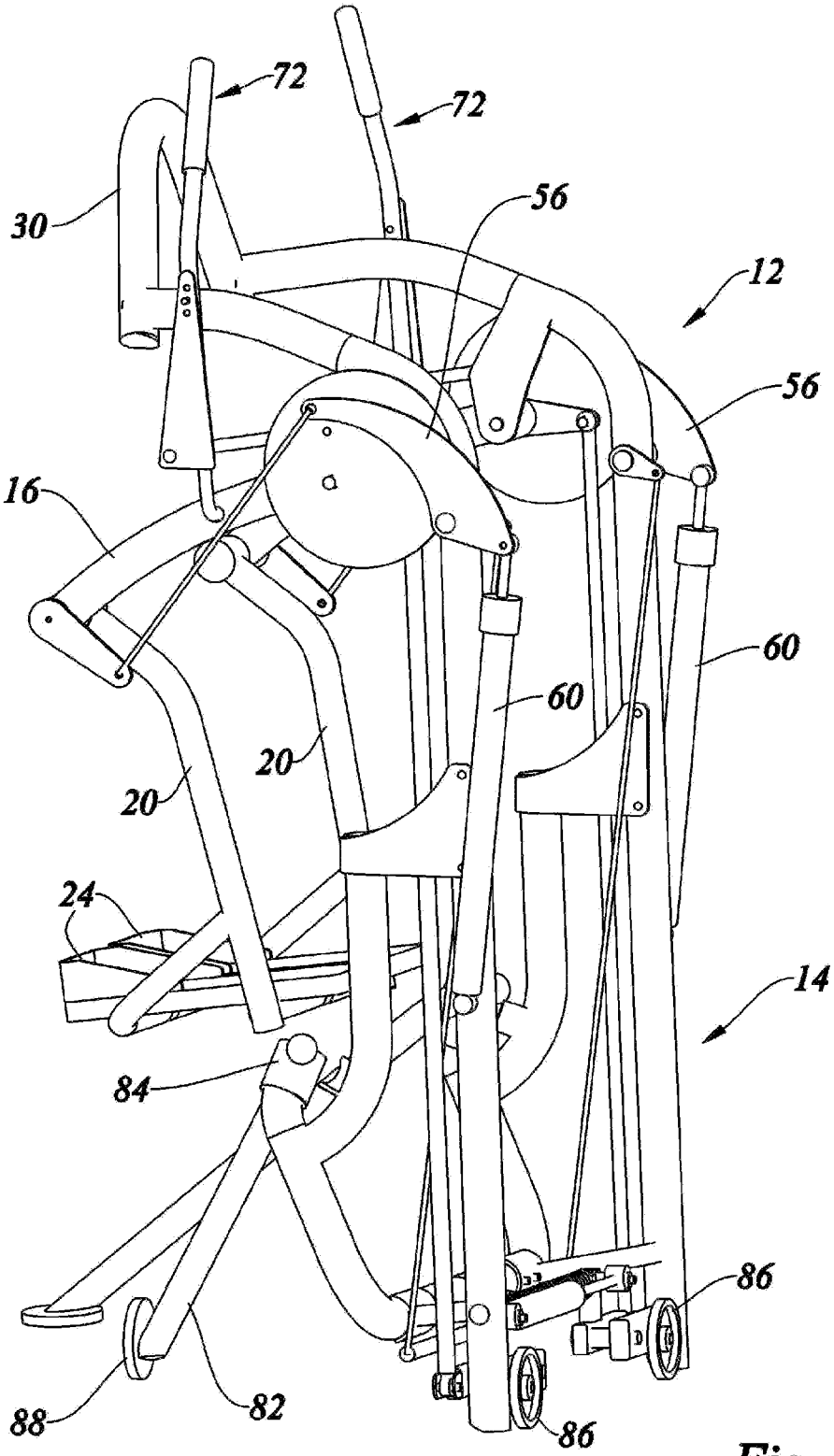
FIG. 9 is an isometric view of the device of FIG. 8 as it may be configured for storage or transport.

Storage and portability may be desirable features of items in both a commercial and home environment. It may be desirable to have a product that is capable of easily breaking down to a smaller size and rolling it out of the way so that piece of real estate can then be used for something else. At home that can be setting up to exercise in front of the television in the living room and then move the device 12 away after the workout. In a health club environment a space such as a group exercise room may be used for a variety of different classes. In that case, the equipment used may be brought out to use for one class and then put away when the room is used for a different exercise class. Therefore, it may be desirable for the device 12 to be as small as possible for storage and easily moved to make room for the other activity. An example of how this may be accomplished for the device 12 is shown in FIGS. 8 and 9.

The frame 14 of the device 12 may include a front leg 82, which may be rotatably movable with respect to the rest of the frame 14. This may be accomplished by use of a knuckle 84, which may support the front leg 82 and be movably mounted to the frame 14. There may also be one or more rear wheels 86, which may be positioned such that the device 12 may be supported on the rear wheels 86 and be moved sideways or caster wheels that may allow for multi-directional movement. The rear wheels 86 may be mounted to the frame 14 such that when the front of the device 12 is elevated, the device 12 is then supported on the rear wheels 86 and no longer with the frame 12 on the floor. Articulation of the front leg 82 may cause this elevation of the front of the device 12 to engage the rear wheels 86 with the floor. The front leg 82 may also include a front wheel 88 so that when the front leg 82 is rotated back by way of the knuckle 84, the front wheel 88 makes contact with the floor. This elevates the front of the frame 14 so that the rest of the frame 14 is supported by the rear wheels 86. This may enable the device 12 to be supported on the front wheel 88 and rear wheels 86 so that the device 12 may be easily moved by a user. It is noted that the rear wheels 86 and front wheel 88 are shown here to rotate about a single axis. It is understood that any type of wheel, such as a caster wheel with a movable axis of rotation, may also be used in place of one or both wheels (86 and 88).

It may be desirable to feel a small rebound when the foot of a user "kicks off" with the back leg while running or walking. This may be difficult with a running surface or running shoe as ground reaction forces against the bottom of the foot are typically highest at heel strike or at mid stance, when the foot is directly under the body of the runner or walker. The "toe off" phase is when the foot is extended behind the person. There is therefore a time delay between these high impact periods when the impulse energy is transferred into the running surface (or shoe) and the toe off, when the energy is desired to be given back to the person. As the ground reaction force at toe off is less than at heel strike or mid stance, the impulse force from the collision of the foot with the running surface is usually dissipated before the toe off phase can occur. In this way, the user may lose the "spring" feeling of projecting their foot up and forward.

Figure 10:
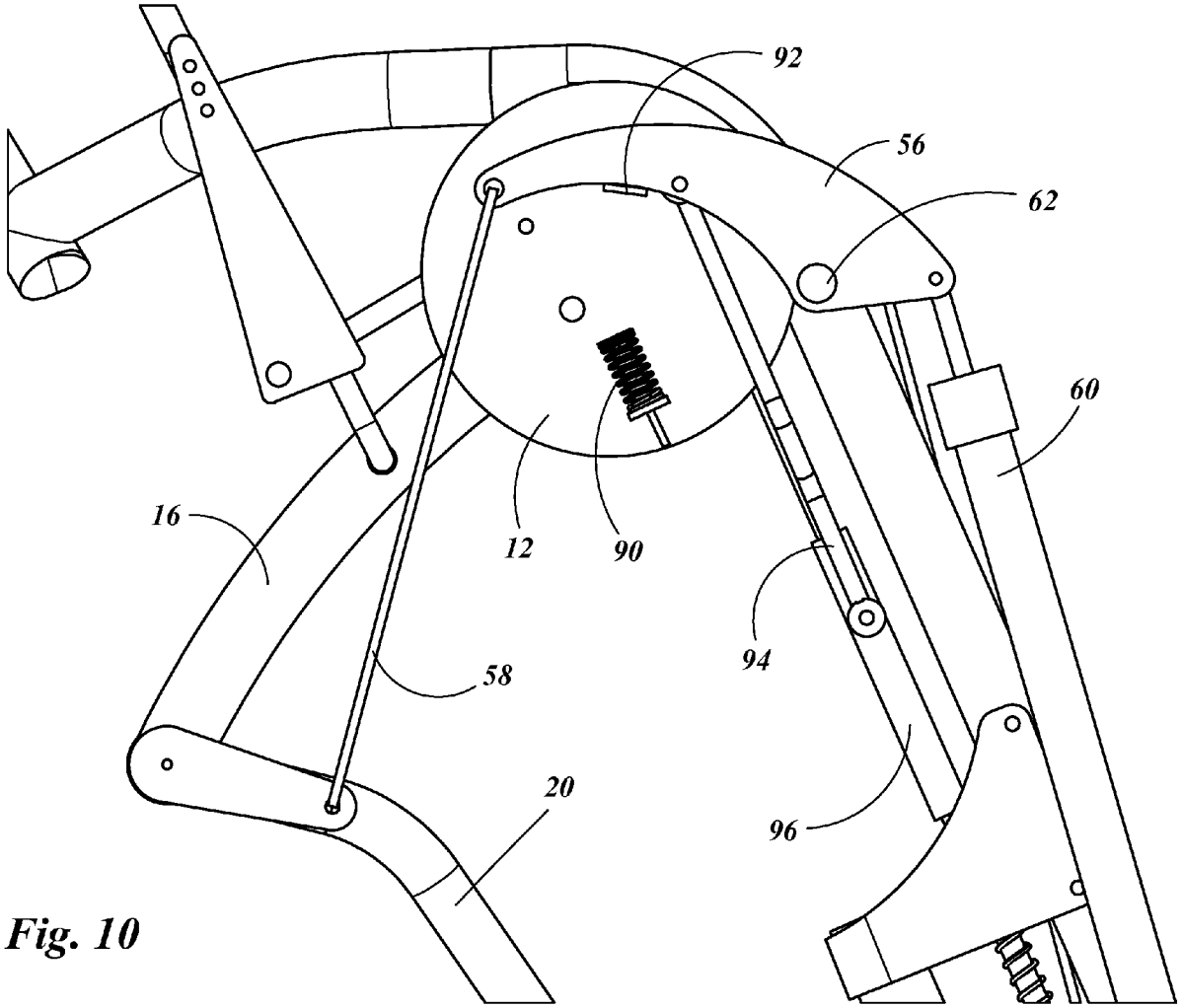
FIG. 10 is a side view of the device of FIG. 1 with a foot bottom rebound system added.
Figure 11:
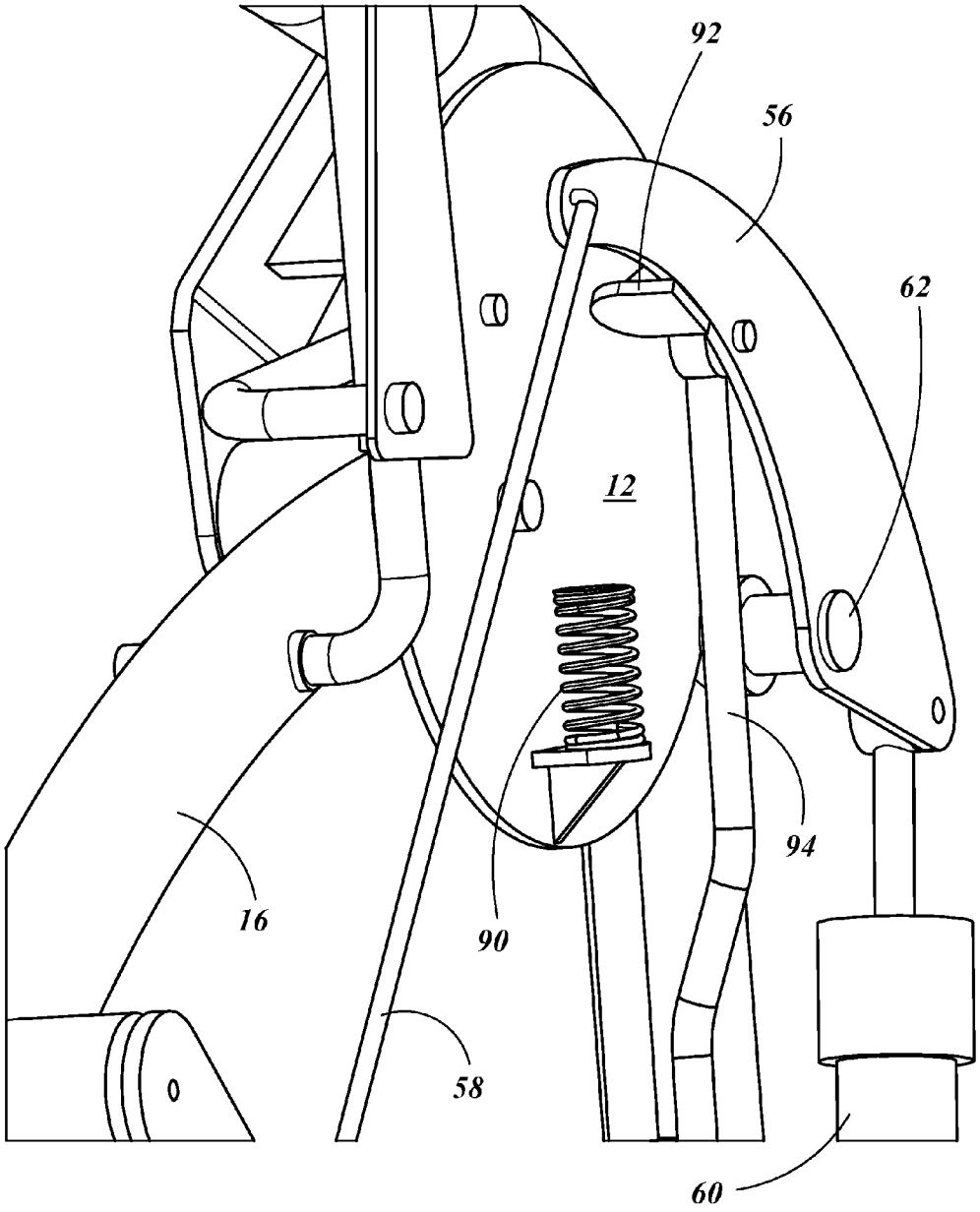
FIG. 11 is an isometric partial view of the device of FIG. 10 showing more detail of the foot bottom rebound system.

In one embodiment of the present invention, as shown in FIGS. 10 and 11 a foot rebound system is provided. In this embodiment, a rebound spring 90 is presented as being supported on the frame 14 of the device 12. An impact tab 92 may be secured to the drive ear 56. As the user extends one of the lower links 20 and rotates the upper link 16 on the same side of the device 12, the drive ear 56 may be rotated downward until the impact tab 92 contacts the rebound spring 90. When the impact tab 92 on the drive ear 56 has rotated far enough down to contact the rebound spring 90, the pedal 24 on that side of the device 12 may be at a rearward position, near the "toe off" phase of a walking or running gait. This is when the foot is back behind the hip of the user. In this position, the impact tab 92 may strike the rebound spring 90 and cause a quick recoil to drive the drive ear 56 and therefore the lower link 20 and pedal 24 upward, giving the user a user a literal "spring" in their step.

A system to provide more gradual spring recoil can be seen in FIGS. 1 and 5. In this embodiment the drive ear 56 may actuate a drive rod 94. The drive rod 94 may be pivotally coupled to the drive ear 56. Opposite to the connection to the drive ear 56, the drive rod 94 may be pivotally coupled to a sleeve 96. The sleeve 96 may be received over the pushrod 26. This is not a required combination, but for efficiency of parts, this may be desirable. Positioned on the lower side of the sleeve 96 may be a compression spring 98. As the drive ear 56 is rotated down, as is the case as a user extends and drives the pedal 24 on that side of the device 12 down and back, the drive rod 94 may force the sleeve 96 into the compression spring 98, thus compressing the compression spring 98 and storing potential energy to recoil the drive ear 56, and corresponding pedal 24, back upward.

The compression spring 98 may also be compressed from below by the action of the pushrod 26 when pulled upward, thus pulling the bottom of the pushrod toward the sleeve 96, with the compression spring 98 positioned there between. This combination of the compression of the compression spring 98 from both ends may enhance the lift of the pedals 24 and the forward return lift action to the upper links 16, as well as redirecting some of the rearward leg momentum of the user. Extending the lower link 20 alone if the lower link 20 is in a forward position may not cause a compression of the compression spring 98. This may be desirable in that any force generated by the compression spring 98 may not inhibit the forward rotation of the lower link 20, and therefore extension of the knee of the user, when the leg is positioned forward, near heal strike. This may be preferred, as full extension of the knee of the user in this position may be desired in a normal gait. As noted, this may be a gradual spring force generated throughout the movement of the drive ear 56. This is different from the rebound spring 90, which is only engaged near the end of the stride of the user.

Figure 12:
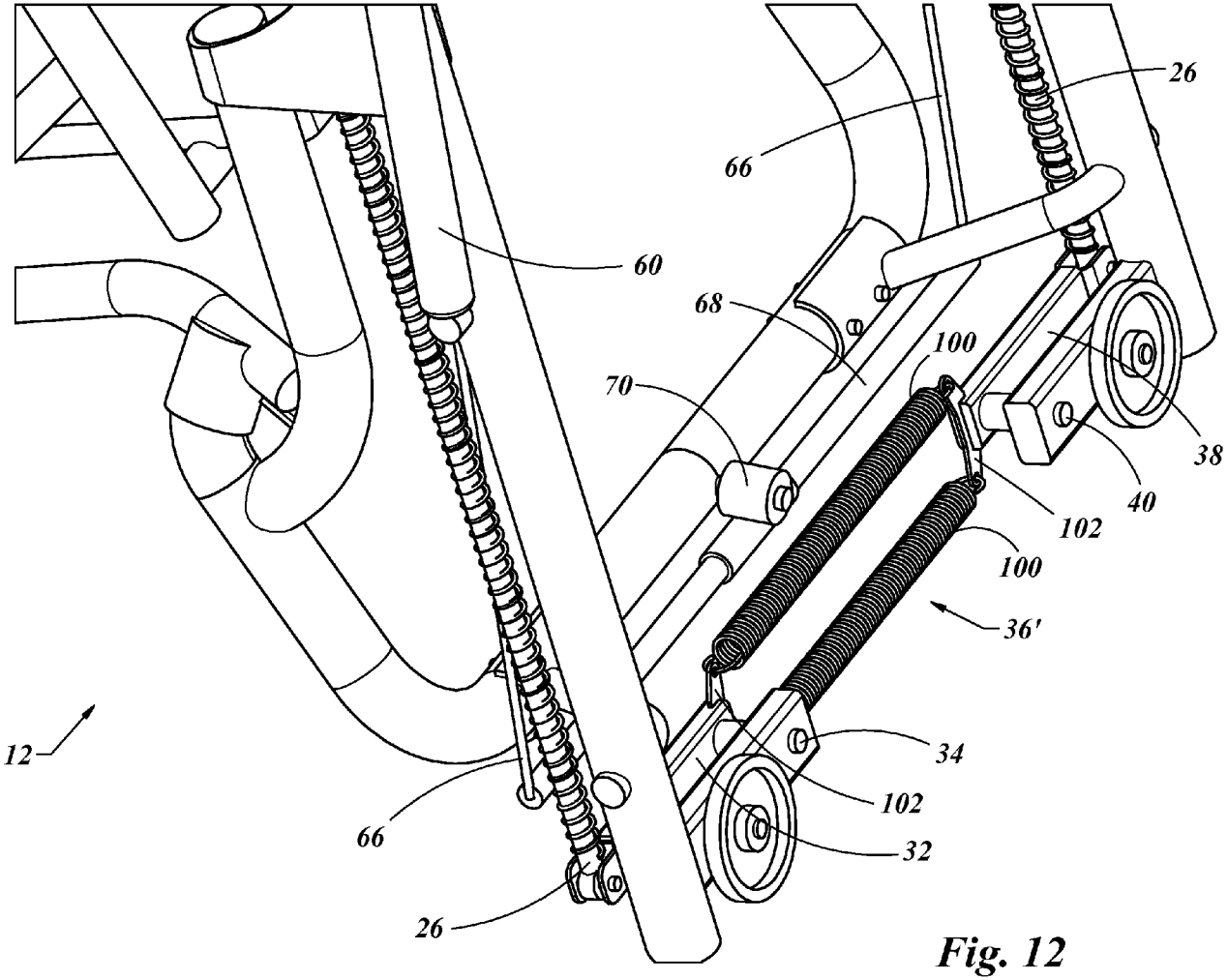
FIG. 12 is an isometric partial view of the device of FIG. 5 with a modified pliable connector.

A modified pliable connector 36' is shown in FIG. 12. The combination as previously shown in FIGS. 1-6 may be simplified to provide one or more tension springs 100, each in communication with the left damper arm 32 and the right damper arm 38 by way of the damper arm ears 102. In the embodiment shown in FIG. 12, there may be two tension springs 100, each alone generating a moment to bias the left damper arm 32 and the right damper arm 38 in an opposite angular orientation. Each of the two tension springs 100 may be positioned an equal distance from the left damper pin 34 and likewise an equal distance from the right damper pin 40. In doing so, the moment generated by the forces applied by the tension springs 100 to rotate the left damper arm 32 and the right damper arm 38 may be balanced by the tension in the other spring 100. The result may be a pliable connector 36' which allows for movement between the left damper arm 32 and the right damper arm 38, thus adding some freedom of movement between the pushrods 26, and therefore the upper links 16, on either side of the device 12. The balance of the tension springs 100 may work to balance one another and in doing so default the left damper arm 32 and the right damper arm 38 to a neutral orientation where the left damper arm 32 and the right damper arm 38 are displaced from the horizontal an equal angular distance but opposite in direction to one another. This combination may provide compliance between the left side and the right sides while being biased toward reciprocating motion of the pushrods 26 on either side of the device 12.

Figure 13:
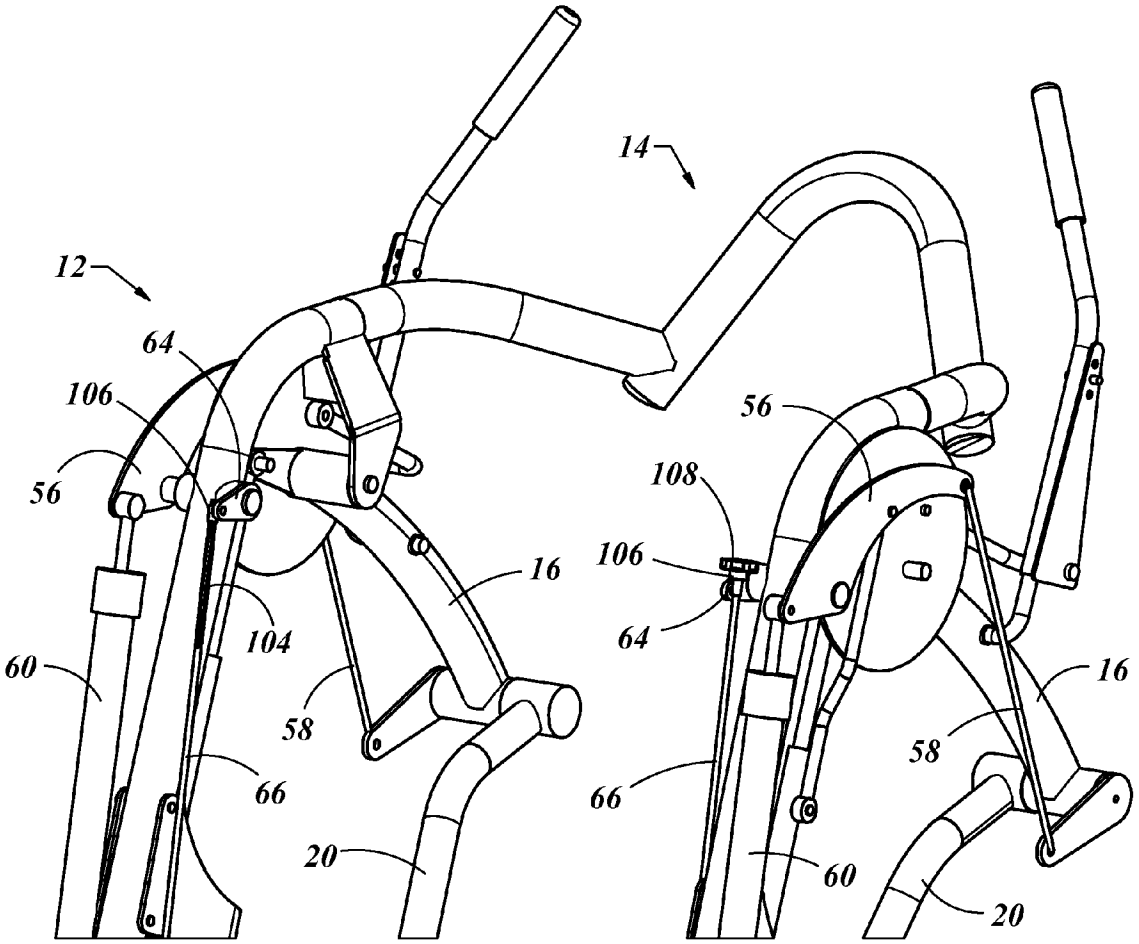
FIG. 13 is an isometric partial view of the device of FIG. 2 showing two alternative versions of an adjustable front pull-rod system.

It may be desirable to make changes to the device 12. These changes may include alterations to better fit certain users, changes in the height of the pedals 24 to assist ingress and egress of a user into and out of the device 12, or make modifications to better guide a user into different gait patterns. One of these changes may include a modification to the length of the front pull-rods 66. Two examples of how this may be accomplished are shown in FIG. 13. On the left front pull-rod 66 a turnbuckle 104 may be used to connect a nut 106, mounted on the secondary ear 64, to the front pull-rod 66. By rotating the turnbuckle 104, the length between the bottom of the front pull-rod 66 and the secondary ear 64 may be shortened or lengthened.

A similar system is shown on the right front pull-rod 66, only using a knob 108, which may be rotatably coupled to the nut 106. The nut may be coupled to the secondary ear 64 on the right side of the device 12. By rotating the knob 108, the front pull-rod 66 may be shortened or lengthened relative to the position of the secondary ear 64. Either method, or any similar system, may be used to alter the length of the front pull-rods 66. If the length of the front pull-rods 66 is shortened, the respective drive ear 56 may be rotated back, thereby pulling up on the lower leg connector 58, which may pull up the lower links 20 and the pedals 24 thereon. The resulting higher pedals 24 may be desirable for a user to feel more comfortable running at a higher speed running gait. A longer front pull-rod 66 may lower the pedals 24. The lower pedals 24 may be desirable for a user walking at a slower gait. In addition, the lower pedals 24 may be more comfortable for a user to enter the device 12 prior to exercise, or leave the device 12 after a workout, as lower pedals 24 may move less when contacted by one foot at a time by the user stepping on and stepping off the device 12.

Figure 14:
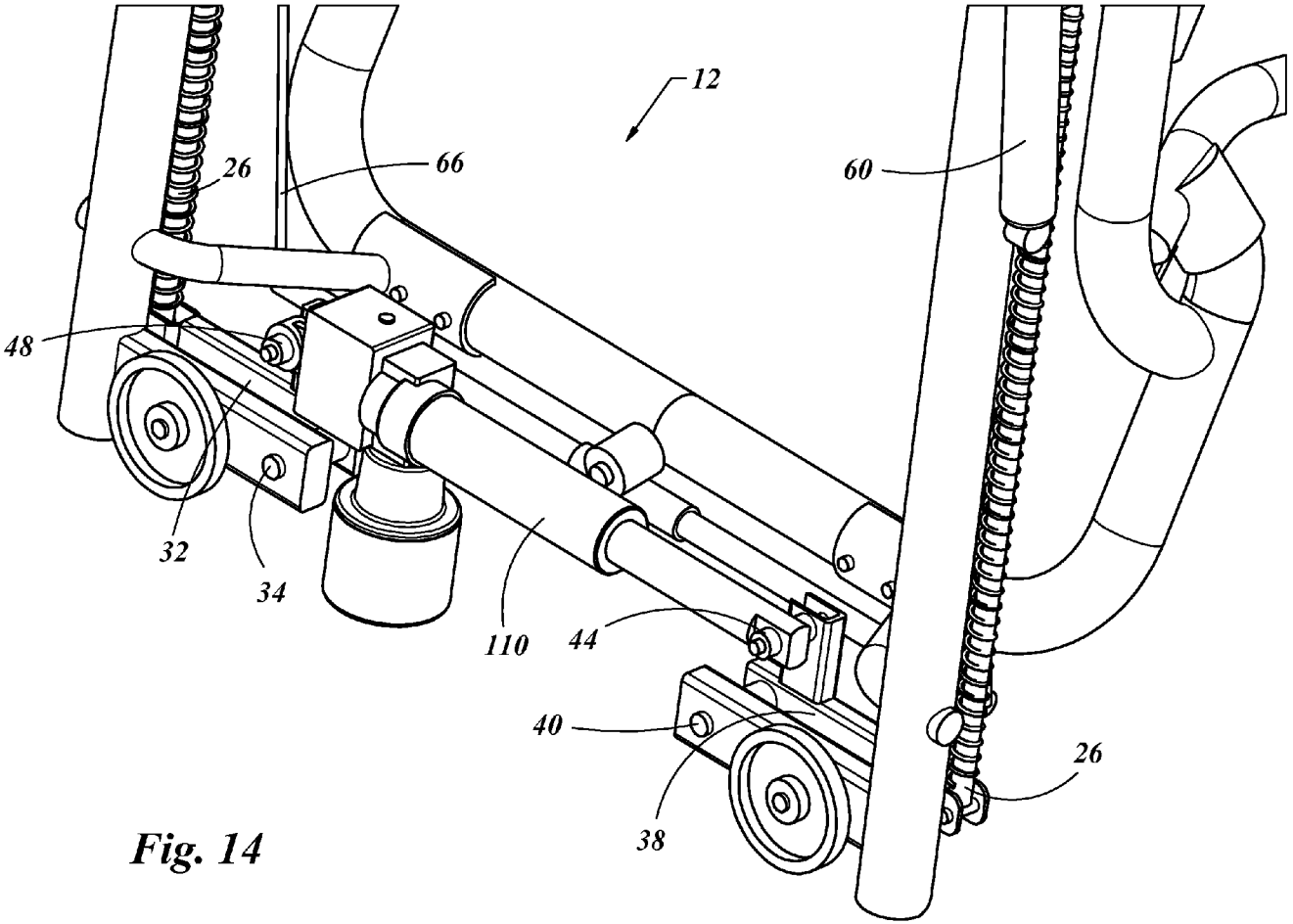
FIG. 14 is an isometric partial view of the device of FIG. 2 showing an adjustable non-pliable connector.
Figure 15:
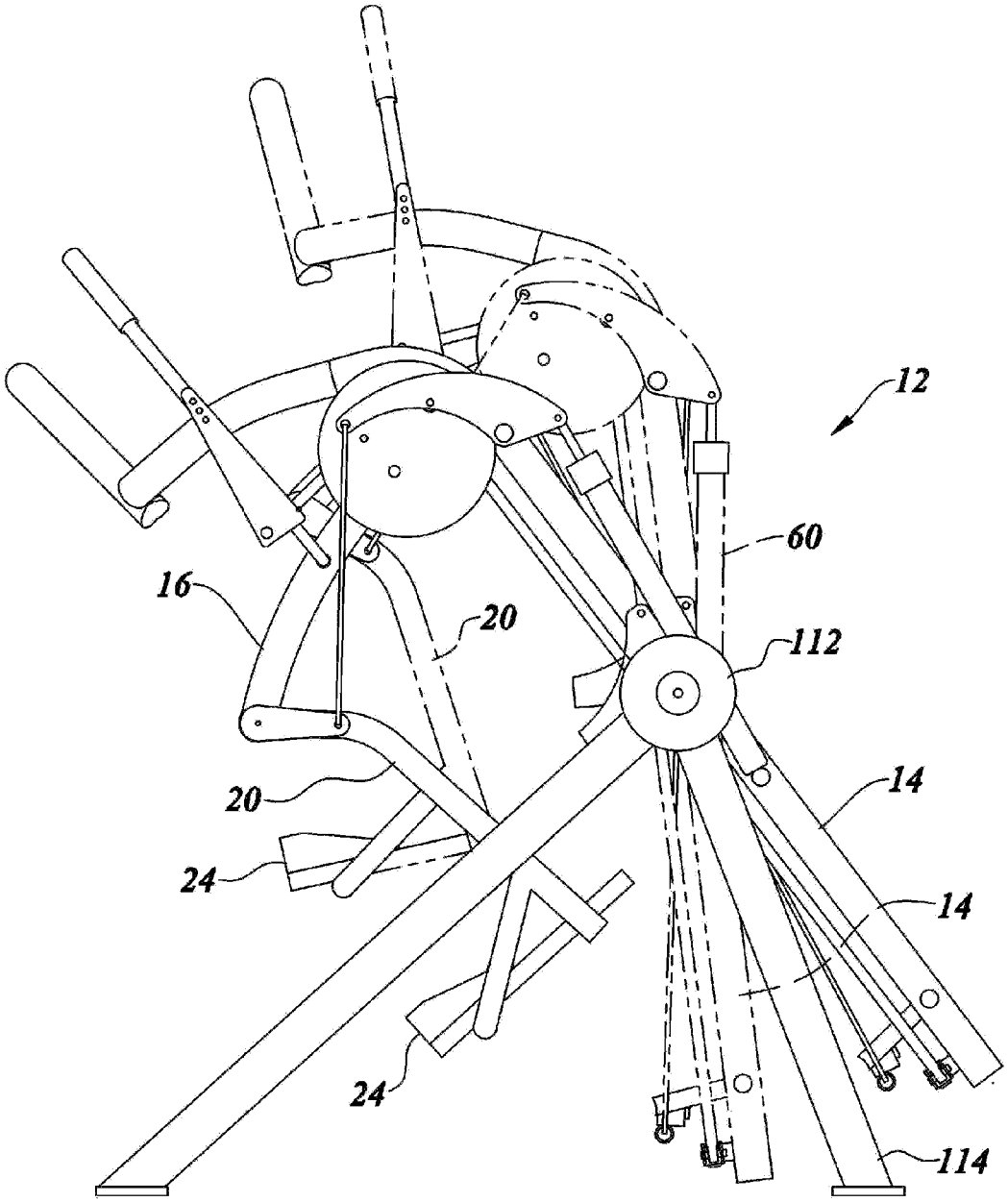
FIG. 15 is a side view of the device of FIG. 1 with a modification to the frame to allow for changes in the angular orientation of the user relative to the ground.

It may also be desirable to provide a system to allow the user to lean forward or backward during the use of the device 12. Prolonged exercise may become repetitive and boring. One way to overcome this repetition may be to alter seemingly small variations to the exercise. This may call into effect different muscle groups, helping to fight fatigue, and create a modified environment for the user. Two methods of altering the angle of orientation of the user on the device 12 are shown in FIGS. 14 and 15. In FIG. 14, the previously disclosed pliable connector 36 has been replaced with a non-pliable actuator 110. The actuator 110 may offer an adjustment in the length between the right shaft 44 and the left shaft 48. The left damper arm 32 and the right damper arm 38 may still be pivotally coupled to the frame 12 at the left damper pin 34 and right damper pin 40 respectively. Therefore, if the actuator 110 is shortened, the left damper arm 32 and the right damper arm 38 may rotate upward, pushing the pushrods 26 up. Upward movement of the pushrods 26 may drive the upper links 16 down and back, thus simulating a downhill running gait. The opposite may also be true if the actuator 110 is extended. This may cause the pushrods 26 to move down, and elevate the upper links 16, thereby simulating an uphill gait.

A more direct system is shown in FIG. 15. Here the frame 14 is shown in two positions, one forward with phantom lines and rearward with solid lines. A rotary mount 112 may be used to secure the frame 14 to a base frame 114, while allowing the frame 14 to change the angular orientation relative to the base frame 114. The rotary mount 112 may also include a brake so that the user may set a given angular orientation of the frame 14 relative to the base frame 114 and maintain that position throughout the exercise.

The foregoing detailed description of the present invention is provided for purposes of illustration, and it is not intended to be exhaustive or to limit the invention to the particular embodiment shown. The embodiments may provide different capabilities and benefits, depending on the configuration used to implement key features of the invention.

The invention claimed is:

1. An exercise device, comprising:

a frame;

a first and a second upper link, each including a first end pivotally coupled to the frame and a second end opposite to the first end;

a first and a second lower link, each including a first end pivotally coupled to the second end of the first and the second upper links;

a pair of pedals, each coupled to a second end of the first and second lower links, the pedals suited for supporting the weight of a user; and a first and a second pushrod, each with a first end pivotally coupled to each upper link and a second end opposite to the first end;

a first and a second pivot arm, each pivotally coupled to the frame, the first pivot arm receiving the second end of the first pushrod and the second pivot arm receiving the second end of the second pushrod; and a pliable connector coupled to the first pivot arm and the second pivot arm, whereby the pliable connector may allow for pliable reciprocating movement of the first pivot arm relative to the second pivot arm and thereby, the first upper link relative to the second upper link.

2. The exercise device according to claim 1, further comprising a connector damper in parallel with the pliable connector, thus damping the movement of the first pivot arm relative to the second pivot arm.

3. The exercise device according to claim 1, further comprising a drive ear pivotally coupled to the frame at a frame pivot, the drive ear coupled to a leg damper on a first side of the frame pivot and a lower leg connector on a second side of the frame pivot.

4. The exercise device according to claim 3, further comprising a spring positioned to bias the drive ear toward compression of the leg damper.

5. The exercise device according to claim 1, further comprising a pair of frame wheels coupled to the frame to enable side to side motion of the frame when supported on the frame wheels.

6. The exercise device according to claim 5, wherein the frame includes a front leg which is movably coupled to the rest of the frame, and the front leg including a leg wheel, whereby movement of the front leg enables the leg wheel to run parallel to the frame wheels.

7. The exercise device according to claim 1, further comprising a handle pivotally coupled to the first upper link and an arm bar with a first pivot on the handle and a second pivot on the frame.

8. The exercise device according to claim 1, further comprising a rebound spring mounted on the frame and proximate to the drive ear, such that the rebound spring provides an interference to continued movement of the drive ear.

* * * * *